US006394042B1

(12) United States Patent
West

(10) Patent No.: US 6,394,042 B1
(45) Date of Patent: May 28, 2002

(54) GAS FIRED TUBE AND SHELL HEAT EXCHANGER

(75) Inventor: John W. West, Bennington, KS (US)

(73) Assignee: Callabresi Combustion Systems, Inc, Salina, KS (US)

( * ) Notice: Subject to any disclaimer, the term of this patent is extended or adjusted under 35 U.S.C. 154(b) by 0 days.

(21) Appl. No.: 09/391,790

(22) Filed: Sep. 8, 1999

(51) Int. Cl.[7] ..... F22B 1/02

(52) U.S. Cl. ..... 122/32; 122/52; 122/367.2; 110/234

(58) Field of Search ..... 122/149, 14.2, 122/14.21, 14.3, 14.31, 504, 507, 367.1, 367.2, 13.3, 32, 33, 52; 137/487.5; 110/234

(56) References Cited

U.S. PATENT DOCUMENTS

| | | | | | |
|---|---|---|---|---|---|
| 2,495,673 | A | * | 1/1950 | Erwin | 122/52 |
| 3,392,711 | A | * | 7/1968 | Wolfersperger | 122/52 |
| 4,273,074 | A | | 6/1981 | Kuhlmann | 122/7 R |
| 4,314,606 | A | | 2/1982 | Müller | 165/163 |
| 4,441,550 | A | | 4/1984 | Chase | 165/145 |
| 4,450,904 | A | | 5/1984 | Volz | 165/162 |
| 4,475,586 | A | | 10/1984 | Grieb et al. | 165/134 R |
| 4,485,746 | A | * | 12/1984 | Erlandsson | 110/234 |
| 4,549,525 | A | * | 10/1985 | Narang | 122/14.21 |
| 4,557,323 | A | | 12/1985 | Hardy et al. | 165/163 |
| 4,693,271 | A | * | 9/1987 | Hargrove et al. | 137/565 |
| 4,718,481 | A | | 1/1988 | Delatte | 165/108 |
| 4,945,942 | A | * | 8/1990 | Lund | 137/337 |
| 5,088,424 | A | * | 2/1992 | Sardari et al. | 110/344 |
| 5,121,791 | A | | 6/1992 | Casterline | 165/143 |
| 5,186,247 | A | | 2/1993 | Schlemenat | 165/162 |
| 5,253,703 | A | | 10/1993 | Master et al. | 165/82 |
| 5,355,673 | A | * | 10/1994 | Sterling et al. | 60/324 |
| 5,429,059 | A | * | 7/1995 | Wagoner et al. | 110/234 |

OTHER PUBLICATIONS

The CX Tank Heating System; CX System Installation & Start–Up Manual, by Power Flame, Incorporated 1998; pp. 22–22A.

* cited by examiner

*Primary Examiner*—Jiping Lu
(74) *Attorney, Agent, or Firm*—Kenneth W. Iles

(57) ABSTRACT

A gas fired tube and shell heat exchanger directs a flame directly into an inlet end of the tube bundle and the flame and exhaust are drawn through the tube bundle by an induced draft blower located in the exhaust stream outside of the shell. Liquid to be heated is pumped through the shell by an electric pump. In another preferred embodiment, a forced draft blower is placed on behind the burner to force air into the tube bundle. Control features prevent the burner from firing unless there is liquid flow through the shell.

19 Claims, 6 Drawing Sheets

POWER
PILOT
PL-1
PL-3
112
128
116
114
ES-2
ES-1
TDR-1
L1
L2
120
L-1
142
LC-2
LC-1
140
FUSE
126
PS-1
124
FLOW SWITCH
122
CS-1
134
HIGH FIRE
PL-5
210
214
212
HF2
HF1
HFC
220
H1
218
2
D1
DAMPER MOTOR
216
3
4
222
GV2
196
GV1
224
2
198
LOW FIRE GAS VALVE
HIGH FIRE GAS VALVE

GAS FIRED TUBE AND SHELL HEAT EXCHANGER

BACKGROUND OF THE INVENTION

1. Field of the Invention

The present invention is related to an apparatus and process for efficiently heating fluids in a vented open system. More particularly, the present invention is directed to a system in which a gas burner flame passes through a tube bundle which is encased in a shell that is filled with a fluid to be heated.

2. Description of Related Art Including Information Disclosed Under 37 C.F.R. Sections 1.97–1.99

Many applications require transferring heat from one place to another or from one medium to another. Many types of heat exchangers have been developed for this purpose. Heat exchangers, as used herein, typically transfer, recover, or usefully eliminate heat from a place where it is not needed, without a phase change in either liquid. This heating is accomplished in a number of ways. In industrial applications, it is known to provide a tube and shell heat exchanger in which the shell encloses a tube bundle and a hot working fluid is passed through the tubes to heat a fluid passing through the shell. The fluids are usually water, but either or both can be a gas, such as steam, air or hydrocarbon vapors; or they may be liquid metals, such as mercury or fused salts.

The conventional industrial heat exchanger requires some system outside the heat exchanger to heat the working fluid. Such systems include, for example, boilers, which use a flame to heat a liquid, which may or may not be heated into steam, which is then passed through the tubes in order to heat another liquid that flows through the shell. Other types of system components that are involved in the heating of liquids and that many users would like to eliminate include steam boilers, feed water pumps, condensate receiver tanks, steam to other liquid heat exchanges, hot oil heaters, electric boilers, and plate heat exchangers. Many applications, however, require only heated liquid and many of these complex systems would be omitted if there were a way to omit them.

This arrangement requires expensive, bulky, complex assemblies with high operating and maintenance costs. These features are sometimes avoided by using electricity for heating, electrical heating is expensive and is economically unsuitable in many applications.

Therefore, there is a need for a heat exchanger that is relatively inexpensive to operate, that is relatively simple in design, that eliminates many of the assemblies required in conventional boiler-operated heat exchangers.

SUMMARY OF THE INVENTION

Accordingly, it is a primary object of the present invention to provide a heat exchanger that is relatively inexpensive to operate.

It is another object of the present invention to provide a heat exchanger that is relatively simple in design.

It is another object of the present invention to provide a heat exchanger that eliminates many of the assemblies required in a conventional boiler-operated heat exchanger.

These and other objects of the present invention are achieved by providing a gas fired tube and shell heat exchanger in which a gas-fired burner projects its flame directly into the inlet end of a tube bundle and the heat from the flame flows directly through the tube bundle. The tube bundle is sealed within a shell, which is a sealed chamber through which a working liquid, such as water, is circulated and is heated by the hot tubes. Air is forced through the tube bundle by either a draft induction blower located at the outlet end of the tube bundle or a forced draft blower located at the inlet. The burner is a gas-fired burner whose flame is encapsulated in a layer of cool air due to the effect of the induction blower drawing air through the tube bundle from the exhaust outlet, so that the flame does not melt or burn through the tubes. The heat exchanger burner can be fueled by natural gas, methane, propane and the like.

A gas fired tube and shell heat exchanger according to the present invention is used, for example, to heat liquid in a vented open system or a pressurized closed loop system. Liquid that may be heated inside the shell include, but are not limited to, process water, heating water, gray water, waxes, petroleum products, caustic liquids, acids, phosphates, cooking oils, chromates, detergents, beers, alkali solutions, brighteners, and so forth. Any liquid can be heated with the present invention, provided that the liquid can be pumped through the shell. A particularly attractive process includes heating water for circulating through in the cooling systems of certain diesel engines that are used to power emergency or peak demand generators. These engines must be kept hot at all times to prevent untimely deterioration of seals and the like and to allow for maximum power generation immediately upon starting.

Liquid being heated in the shell should be pumped through the shell at a rate allowing for maximum or near maximum heat exchange, and at a rate sufficient to prevent overheating of the tubes, which would cause unwanted deposits on the tubes.

Potential applications of the gas fired tube and shell heat exchanger according to the present invention include but are not limited to, metal finishers, hospitals, laundries, chemical manufacturers, appliance manufacturers, schools, colleges, food processors, drink processors, the petroleum industry, power generation plants, agricultural application and any original equipment manufacturer that uses heated liquids in its processes.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENTS

As required by the Patent Statutes and the case law, the preferred embodiment of the present invention and the best mode currently known to the inventor for carrying out the invention are disclosed in detail herein. The embodiments disclosed herein, however, are merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus and process disclosed herein as embodied in any appropriately specific and detailed structure.

Figure 1:
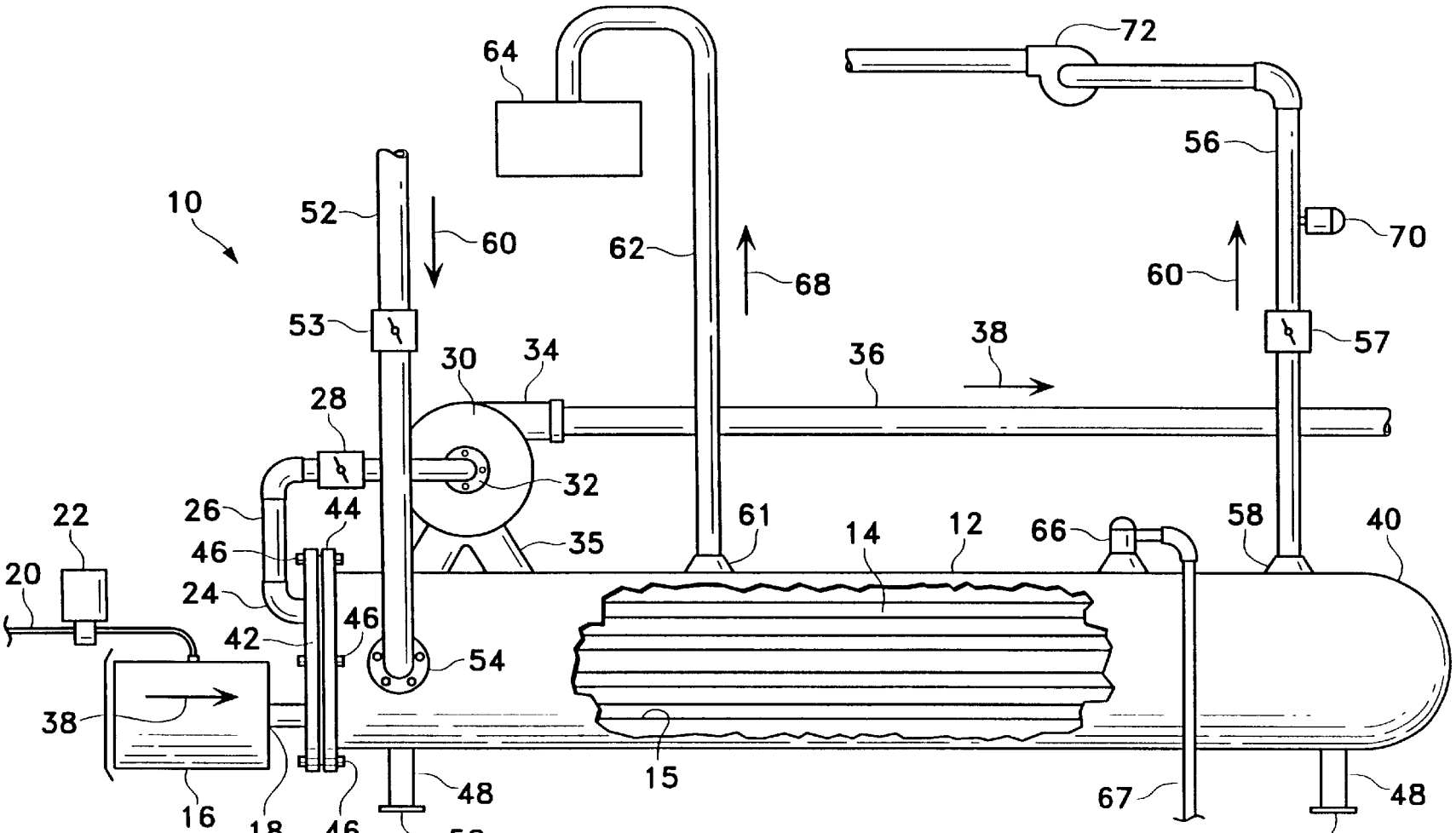
FIG. 1 is a side elevation, partially cut away, of a preferred embodiment of a gas fired tube and shell heat exchanger according to the present invention.
Figure 3:
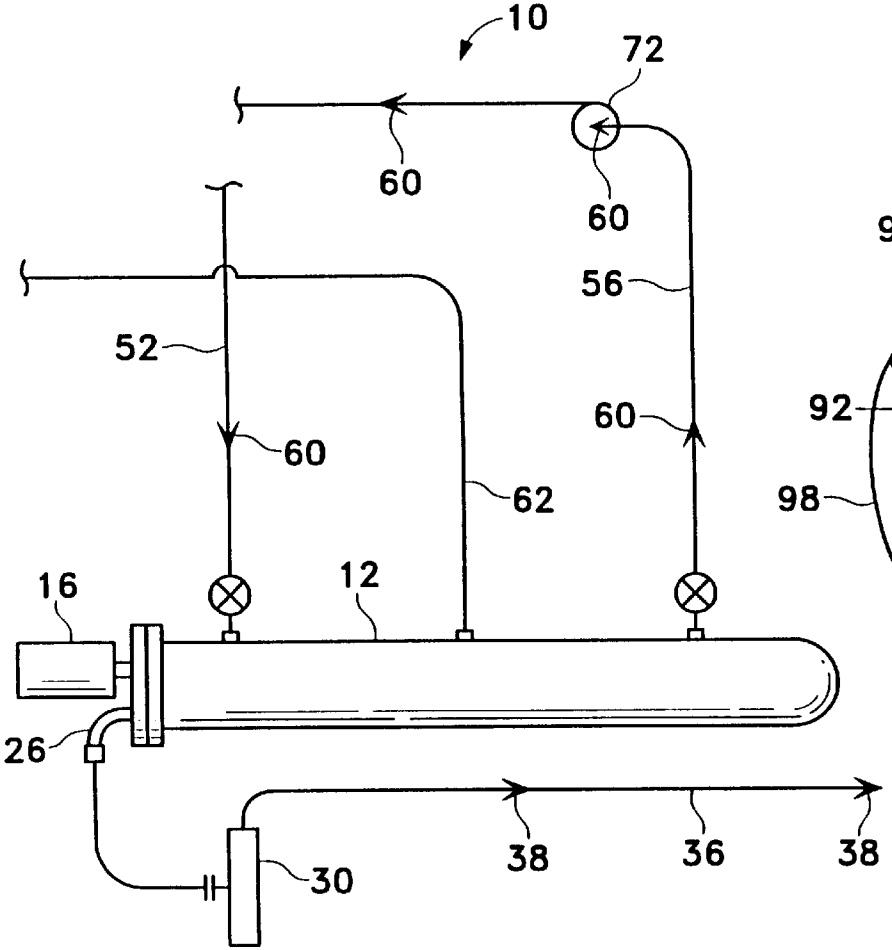
FIG. 3 is a schematic side elevation of the heat exchanger of FIG. 1.
Figure 5:
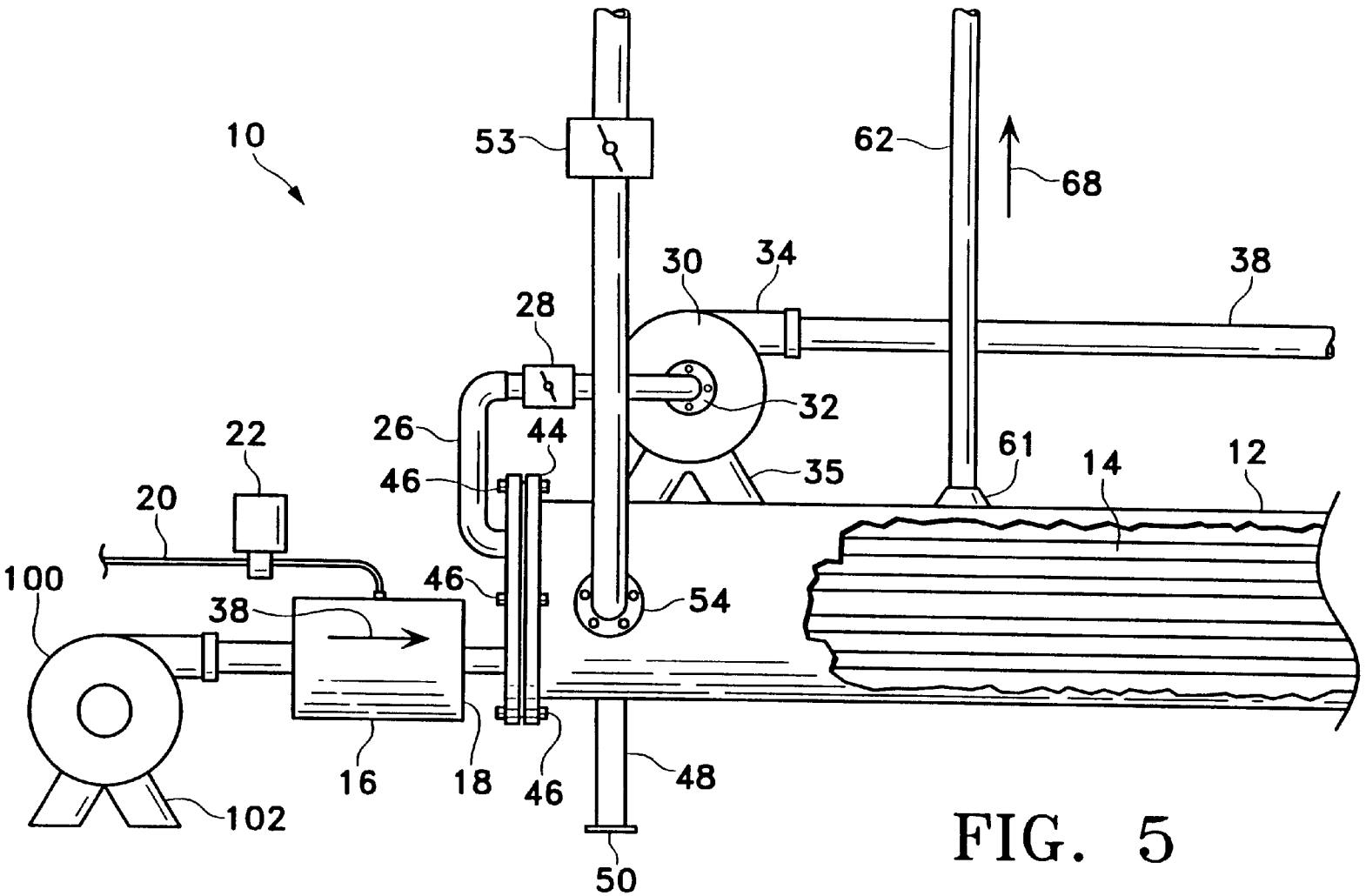
FIG. 5 is a side elevation, partially cut away, of another preferred embodiment of a gas fired tube and shell heat exchanger according to the present invention.

Referring now to FIGS. 1, 3, and 5, in a preferred embodiment, the gas fired tube and shell heat exchanger, or heat exchanger 10, includes a sealed housing or shell 12 that encloses a tube bundle 14, which is seated within the shell 12. A gas-fired burner 16 is attached to an inlet tube 18 of the tube bundle 14. A gas line 20 supplies gas, such as natural gas, through a safety valve 22 to the burner 16. The outlet tube 24 from the tube bundle 14 is connected to an exhaust tube 26, which includes an in-line flue line butterfly valve 28 for controlling the air flow through the tube bundle 14. Downstream of the butterfly valve 28 is an induced draft squirrel cage blower 30 having a blower inlet 32 and a blower outlet 34 connected to a exhaust pipe 36, which is vented to the out-of-doors. The blower 30 is supported on a stand 35. The direction of flow of heated gas and combustion products through the tube bundle 14 is shown by the arrows 38. The heat exchanger 10 can be oriented in space in any desired orientation, for example, horizontal, vertical, or at any angle, because it is sealed and the flows of gas through the tube bundle 14 and the flow of the liquid through the shell 14 are induced by a blower 30 (for the tube bundle 14) or pump 72 (for the liquid in the shell 12).

Still referring to FIGS. 1, 3, and 5, the shell 12 includes a welded dome-shaped cap 40 (on the right-hand end as shown in FIG. 1) and is sealed at the opposite end by a slip weld flange cover 42, which is bolted to a slip weld flange 44 by the nuts and bolts assemblies 46. The welded dome-shaped cap 40 can be replaced with a conventional flat blind flange fitting, which is removable, to provide better access to the interior of the shell 12 and tube bundle 15 for cleaning and maintenance. The heat exchanger 10 is supported on four legs 48 having feet 50. To achieve more even weight distribution on the floor, the feet 50 may be placed on a skid member (not shown) that runs the length of the heat exchanger 10. A shell liquid inlet tube 52 allows for the inflow of the liquid to be heated into the shell 12 and is sealed by the flange seal 54. The rate of flow of the liquid through the shell 12 is controlled by the inlet tube 52 butterfly valve 53. A shell liquid outlet tube, or return to system tube, 56 is sealed into the shell 12 by the outlet flange seal 58. The direction of flow of liquid to be heated is indicated by the shell liquid flow arrows 60. The rate of flow through the outlet tube 56 is controlled by the outlet tube 56 butterfly valve 57. The butterfly valves 53, 57 and 28 are automatically controlled and actuated by electrical signals from the control system.

Still referring to FIGS. 1, 3, and 5, a vent pipe 62, sealed into the shell 12 by the vent tube flange seal 61, leads to and opens into an expansion tank (not shown) in case the liquid inside the closed system of the shell 12, shell inlet and outlet pipes 52, 56 and the associated sealed hot liquid system expands too much for the system to hold it. Then excess volume of liquid flows into the expansion tank 64, which has a pressure relief valve 66, which consists of a threaded nipple, a ball valve, and which is connected to the drain line 67. The closed system is best in applications where purity of the heated liquid or environmental concerns may be associated with the escape of the heated liquid into the environment or where the higher temperatures and greater heat transfer rates associated with pressurized vessels are needed. Open systems include, for example, open slurry tanks, plating tanks, lagoons, vented storage tanks and so forth in which the circulating liquid in the shell 12 is not necessarily wholly recycled through the shell 12 since the volume of heated water, for example, in a lagoon, is large enough so that heated water sent back into the lagoon may not itself be returned to the shell for many hours, if ever. A closed system, requires a properly sized expansion tank 64. Expansion liquid flows upwardly in the direction of the arrow 68. Should the liquid cool sufficiently to reduce the volume of liquid, some liquid in the expansion tank 64 flows back down the expansion vent pipe 62 into the shell for further heating and flow to the ultimate heat use site. Another preferred embodiment, however, is a pressurized closed system that is not vented at all and may be built either with an expansion tank or without an expansion tank. The closed system pressure vessels in this preferred embodiment of the heat exchanger 10 are built to ASME Section 1 Standards for fired pressure vessels, that is, within the design limitations of the material being used for construction. The normal material used for the tube bundle 14 and shell 12 is carbon steel.

A flow switch 70 detects the movement of liquid through the shell 12 by testing for flow in the shell liquid outlet tube 56 and prevents the burner 16 from firing when there is no flow. Flow is induced throughout the shell 12 and associated system by the circulating pump 72, which is electrically operated. Without the circulating pump 72 to force convection of the heated liquid in the shell 12, the heat exchanger 10 would lose much of its efficiency. The circulating pump 72 is crucial to the operation of the heat exchanger 10, as without the pump 72 forcing liquid through the shell 12, only convection would force the liquid through the shell 12 and flow would be substantially stagnant. The direction of flow of liquid through the shell 12, however, has no effect on efficiency and so does not matter. This allows more flexibility in installation of the heat exchanger 10, with the direction of flow through the shell 12 perhaps being determined by local siting conditions. In any case, it is preferred that the pump 72 be oriented so that it pumps liquid away from the shell 12 in order to reduce the pressure head in the shell 12 and allow higher operating temperatures and pressures.

Figure 2:
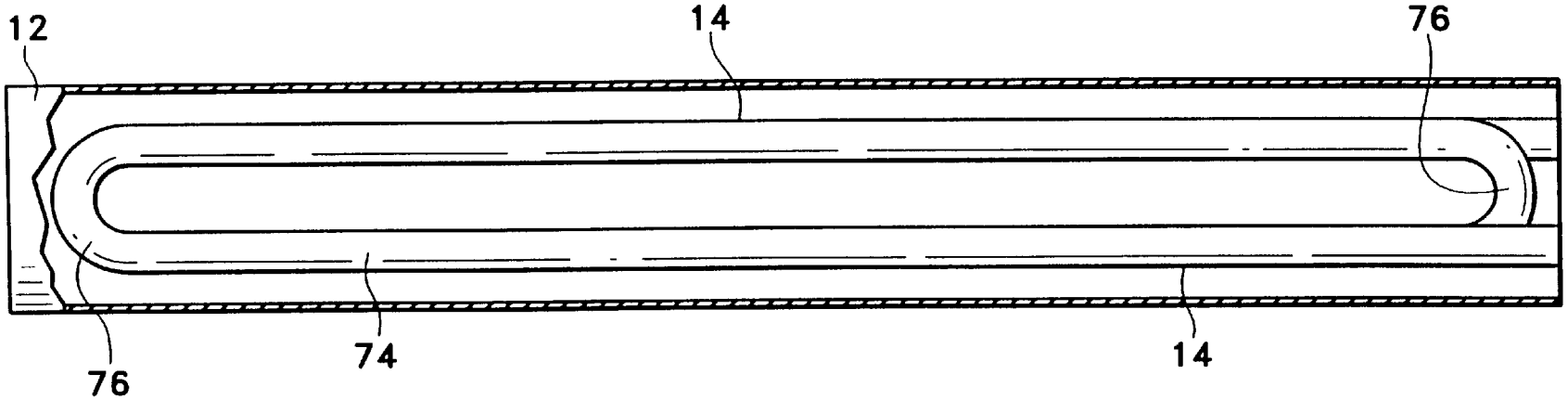
FIG. 2 is a side elevation of the heat exchanger of FIG. 1 showing the tube bundle.

Referring to FIG. 2, the tube bundle 14 consists of a plurality of tube sections welded together with appropriate elbows 76 to form the tube bundle 14 as shown. The tubes 15 in the tube bundle 14 are made in lengths of four feet (1.22 m), six feet (1.8 m), eight feet (2.43 m) and ten feet (3.05 m). The tube bundle 14 is a typical four-pass tube bundle, but may include as many as eight passes. The effective length of the tubes in the tube bundle is limited by the capacity of the induced draft blower 30 and or the forced draft blower 100 (See FIG. 5).

Figure 4:
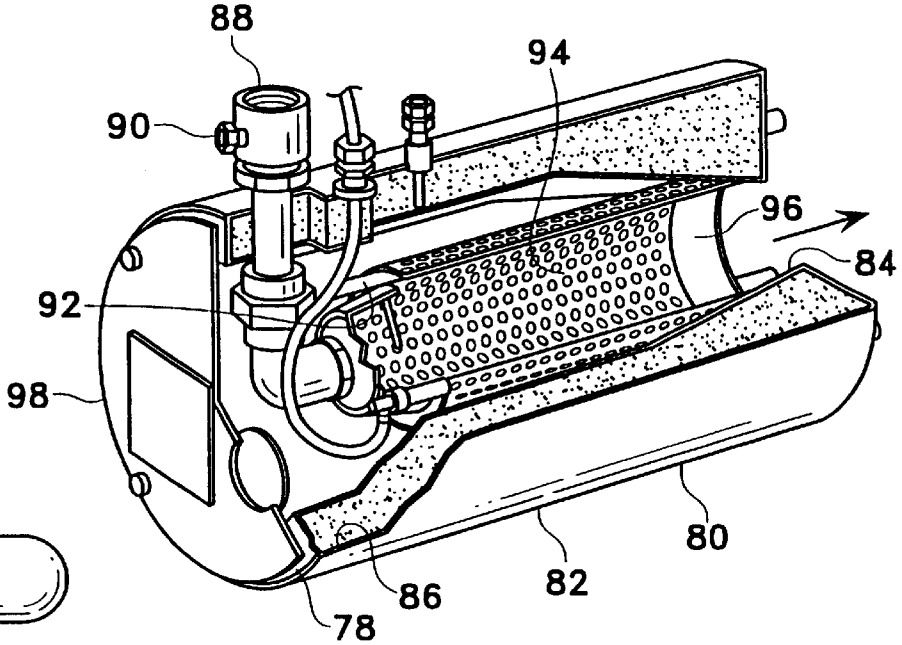
FIG. 4 is a perspective cut away view of a burner for use with the heat exchanger of FIG. 1.

Referring to FIG. 4, the burner 16 includes a combustion air inlet 78 at one end of the burner housing 80, which consists of an outer housing shell 82, an inner housing shell 84, with a layer of sound insulating material 86, such as fiberglass, between the outer housing shell 80 and the inner housing shell 82. Natural gas or other gaseous fuel enters the burner 16 through the gas inlet 88, which includes a gas pressure test port 90. When gas enters the burner 16, an ignition electrode 92 is activated to ignite the gas. A flame retention screen 94 gives direction to the flame and keeps it inside the combustion chamber 94. An air inlet plate 98 set out from the end of the burner housing 80 forms a baffle that allows combustion air to enter the combustion air inlet 78. The burner 16 described herein is currently furnished by a company named Power Flame, Inc. of Parsons, Kans., but it has been found that any burner capable of producing a single longitudinally projected flame is suitable for use with the heat exchanger 10. Incoming line gas pressure can be about 1 lb/in$^2$ ($6.89\times10^4$ dynes/cm$^2$), which is reduced in the safety gas valve to a pressure of 6–14 inches ($1.50–3.5\times10^4$ dynes/cm$^2$) of water column, with about 6 inches ($1.50\times10^4$ dynes/cm$^2$) of water column being desired in many applications. The greater the gas pressure, the more the heat that is produced and in many applications higher gas pressure lead to too much heat.

The ability to send a flame directly into the tube bundle 14 depends on the induction blower 30. When a draft is induced through the tube bundle 14, a layer of ambient air is drawn into the inlet end 18 of the tube bundle. Gas from the burner flame is simultaneously being injected into the central portion of the tube bundle inlet 18 opening. The combination of these two gas streams tends to force the ambient air against the walls of the tube bundle inlet 18, providing a cooling layer of ambient air between the hot flame and the tube walls. Turbulence within the tube bundle 18 mixes these two streams of incoming gas thoroughly within a few feet of the tube bundle inlet 18, but by then the gases have cooled sufficiently to prevent the flame from burning through the tubes in the tube bundle 14. Without the cooling effect of the incoming ambient air adhering to the walls of the tubes 15, the flame would burn through the tubes 15 or dramatically shorten their lives.

Referring now specifically to FIG. 5, another preferred alternative embodiment of the heat exchanger 10 include a forced blower 100 supported by the blower stand 102, which is located at the back of the burner and blows air directly into the burner 16 and, in many cases, additional length to the tube bundle 14, which may for example, include doubling the number of tube passes from four to eight or more. The induced draft blower 30 is still included, so that the forced draft blower 100 is forcing air into the tube bundle 14 along the direction of flow of the air, while at the same time the induced draft blower 30 is drawing air through the tube bundle 14. This design is preferred in applications requiring a relatively high heat output for a particular system. For example, it has been found that a burner 16 producing 400,000 British Thermal Units (BTU) (100,792 kilogram-calorie or large calorie (mean)) of recoverable heat when only an induced draft blower is used can produce 650,000 BTU (163,787 kilogram-calorie or large calorie (mean)) with the addition of additional tube 15 length and the addition of the forced draft blower 100 at the rear end of the burner 16 and with no other changes. With use of an induced blower 30 only naturally leads to pressure drops throughout the tube bundle 14. If the tube 15 length becomes too long, the limits of the induced draft blower 30 prevent efficient use burning. The maximum pressure drop that can be used in most systems is 30 inches ($7.47\times10^4$ dynes/cm$^2$) of water. If the pressure drop from the inlet tube 18 to the exhaust tube 26 exceeds 30 inches ($7.47\times10^4$ dynes/cm$^2$) of water, the addition of the forced draft blower 100 in back of the burner 16 reduces the pressure drop and increases the amount of air flowing through the tubes 15, allowing for the generation of more heat at the burner 16 and greater transfer to the liquid heated in the shell 12. In all other respects, the embodiment shown in FIG. 7 is the same as the embodiment shown in FIGS. 1–6 and discussed above.

Figures 6, 6A, 6B:
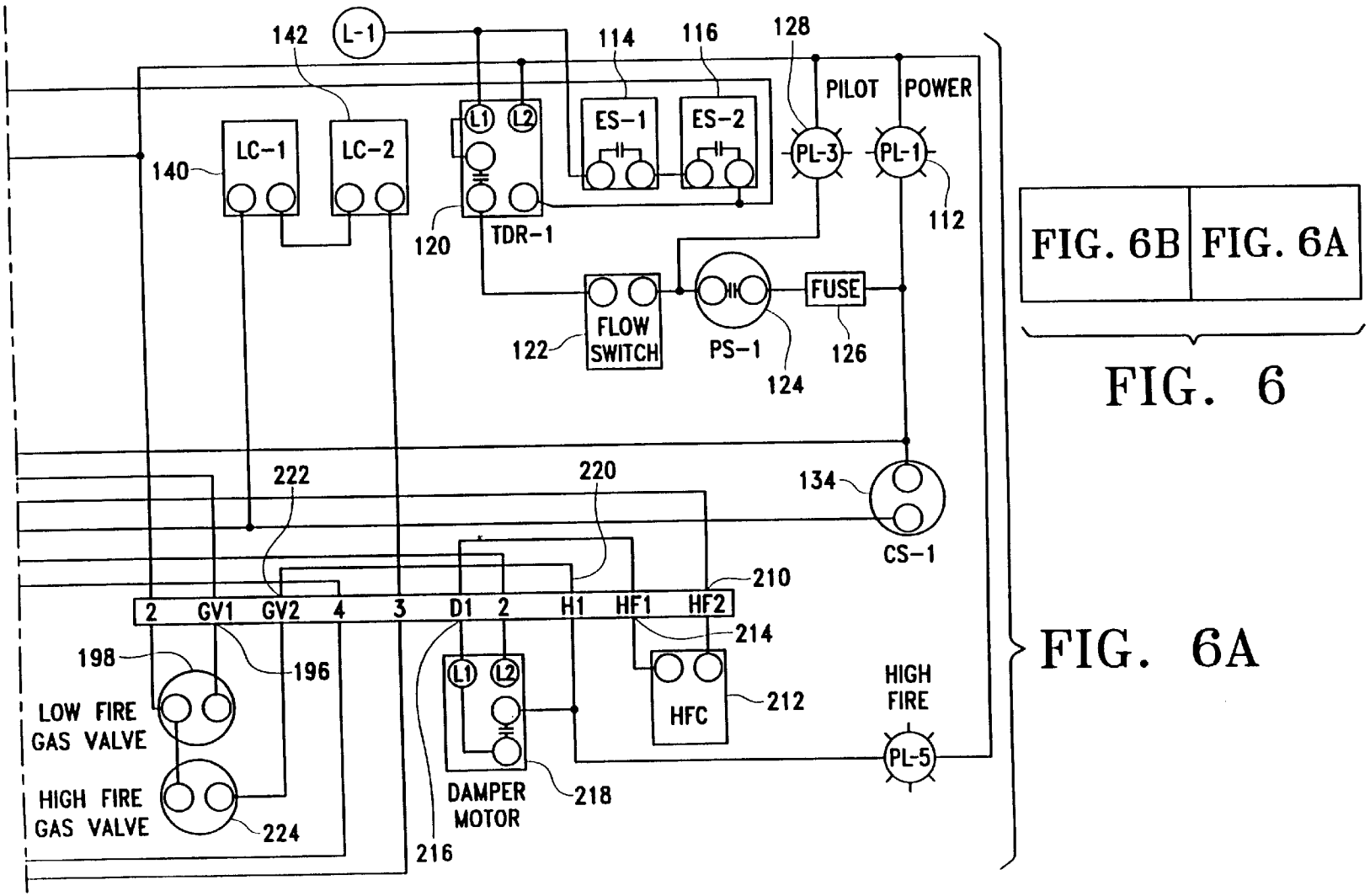
FIG. 6 is a block diagram showing the layout of FIGS. 6A and 6B and represents a schematic of the control system of the heat exchanger of FIG. 1, which is shown on two drawing sheets for the sake of readability.
FIG. 6A is a schematic of the left-hand portion of the control system of FIG. 6.
FIG. 6B is a schematic of the right-hand portion of the control system of FIG. 6.
Figure 6B:
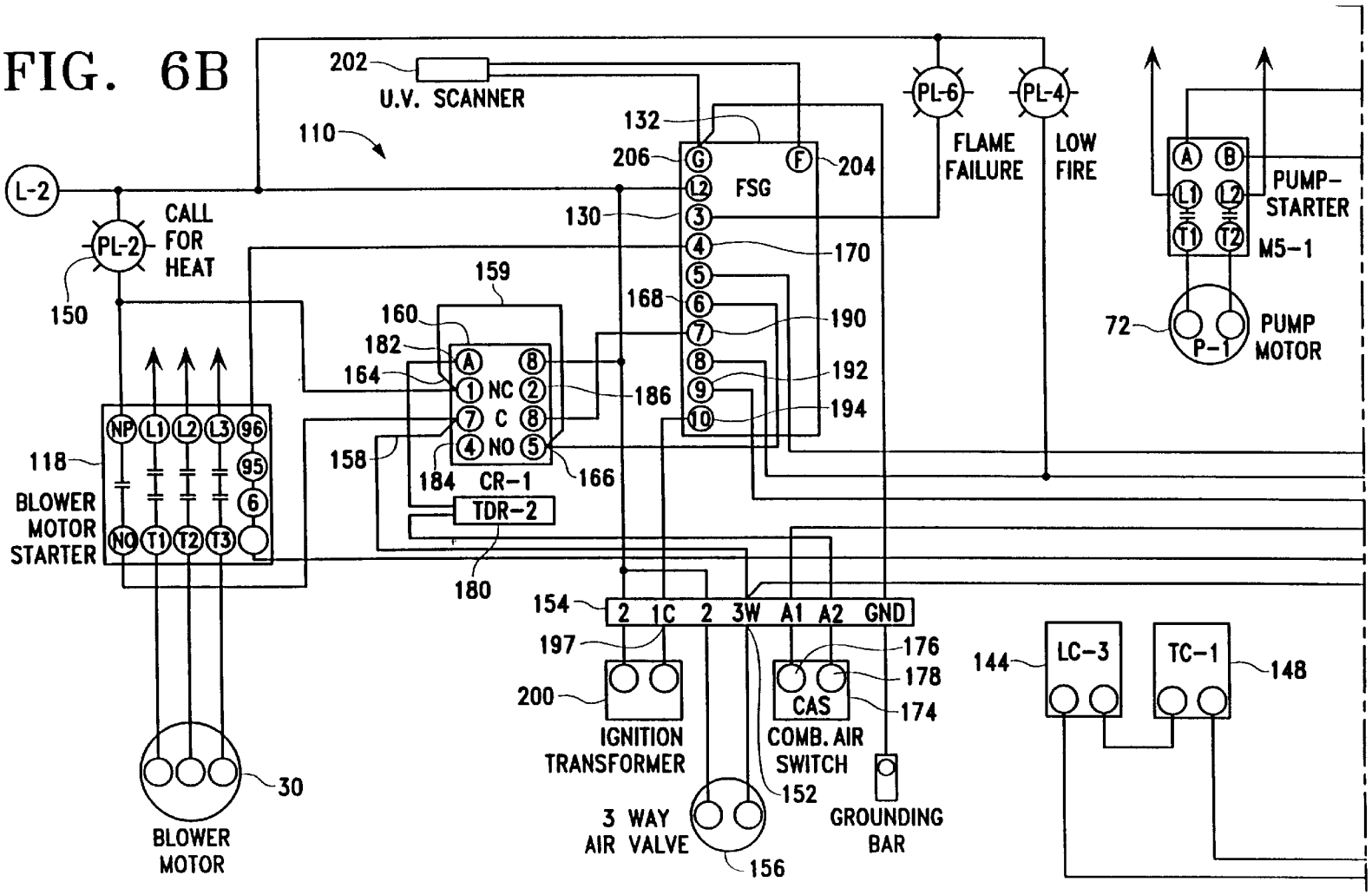

Referring now to FIGS. 6, 6A and 6B, control of the heat exchanger 10 is accomplished though the control circuit 110. When the power switch 112 is turned to the on position, power is applied to the motorized butterfly valves 53, 57 through the valve actuators 114, 116 respectively. When the two butterfly valves 53, 57 reach the 90% open position, end switches in each valve actuator (ES-#1 & ES-#2)114, 116 close contacts that switch on power to the circulating pump (P-#1) 72, the motor starter(Ms-#1) 118, and to the first time delay relay number (TDR-#1) 120. After a thirty second delay, the first time delay relay (TRD-#1) 120 applies power to the flow switch (FS) 122. If positive circulation has been established in the shell 12, the flow switch (FS) 122 will close contacts to apply power to the burner panel switch (PS-#1) 124.

When the burner panel switch (PS-#1)124 is turned to the "on" or "run" position, electrical power is applied to the control circuit 110 the control power filse 126 to the control power "on" pilot light (PL-#1) 128, which lights to indicate that the power is on, and then to terminal #5 130 of the flame safe guard control (FSG) 132, to the control switch (CS-#1) 134, and to the control panel terminal #A1136, which applies power to the combustion air switch (CAS) 138.

When the power is applied to the control circuit 110 through CS-#1 134, power will be applied to the manual reset high temperature limit control (LC-#1) 140. If the temperature within the shell 12 of the heat exchanger 10 is below the set point of the manual reset high temperature limit control (LC-#1), power is then applied to the Manual Reset Low Liquid Level Control (LC-#2) 142. If the liquid level is sufficient within the shell 12 of the heat exchanger 10, then power will be applied to the manual reset high stack temperature control (LC-#3) 144. If the stack temperature is below the set point of the manual reset high stack temperature control LC#3 144, then control power will be applied to the system temperature controller (TC-#) 148, located in the return line 56 coming to the heat exchanger 10 shell 12, if the return liquid temperature is below the set point of the system temperature control TC-#1 148, control power will then be applied to the call for heat pilot light (PL-#2) 150. Terminal #3W 152 of the control panel 154, which power the three-way air valve (AV) 156, terminal #7 158 of the control relay (CR-#1) 160, and normally open (N.O.) auxiliary contacts 162 on control relay (CR-#1) 160 are closed at this point, providing power for terminal #7 158 through normally closed (N.C.) contacts to terminal #1 of control relay (CR-#1) 160. Jumper #1 (JR-#1) 159, that is, the jumper between contacts 1 and 5 of the control relay (CR-#1) 160. Then applies power from terminal #1 164 to terminal #5 166 or the control relay (CR-#1) 160. Terminal #5 166 provides power back to terminal #6 168 of the flame safeguard control FSG control 132, thus completing the circuit call for heat. On a call for heat with power applied to terminal #6 168 on the flame safe guard control (FSG) 132, the flame safe guard control (FSG) 132 recognizes the call for heat and applies power to terminal #4 170 of the flame safe guard control (FSG) 123, then applies power to terminal #96 172 on the blower motor starter 118, which in turn energizes the motor starter coil 118, starting the blower motor 30. The blower motor 30 starts providing combustion air through the burner head 16, then through the heat exchanger tube bundle 14. This process closes contacts on the combustion air switch 174, providing power from terminal #A 176 to terminal A-#1 178, then to the time delay relay #2 (TDR-32) 180. When the blower motor starter 118 energizes, the auxiliary contacts on the blower motor starter 118 close, providing power from terminal #7 158 of the control relay (CR-#1) 160 to terminal #1 164 of the control relay (CR-#1) 160. After ten seconds of purge time, the time delay relay #2 180 closes contacts providing power to terminal #1 182 of the control relay (CR#1)160, closing the N.O. contacts 168, 84 and opening the N.C. contacts 164, 186 of the first control relay (CR-#1) 160, which applies power from terminal #8 188 of the first control relay (CR-#1) 160 to terminal #7 190 of the flame safe guard control (FSG) control 132, thus proving air flow. Power to terminal #7 190 of the flame safe guard control (FSG) 132. Proving air flow causes the flame safe guard control (FSG) 132 to move forward to a thirty second pre purge timing cycle. Upon completion of the pre-purge timing, the flame safe guard control (FSG) 132 applies power to terminal #8 192 and terminal #10 194 of the flame safeguard control (FSG) 132. Terminal #8 192 of the flame safeguard control (FSG) 132 provides power to terminal GV-#1 196 on the panel terminal strip 195, then to the low fire gas valve 198. The steps described to this point take the burner fire to the start and normal operation point.

Terminal #10 of the FSG 160 control provides power to terminal #1-C 197 of the panel terminal strip 154 and then to the ignition transformer 200. The ignition transformer 200 ignites the gas and establishes a flame. The discharge or supply temperature of the heat exchanger 10 is controlled by the high fire operating control (HFC) 212, which controls the firing rate of the burner 16. The heat exchanger 10 normally operates in a low fire, or small flame, mode, but when the flue temperature falls below the desired temperature, the control system turns the burner onto a high fire, or big flame, mode to increase the heat being introduced into the tube bundle 14 and hence into the liquid flowing through the shell 12. When the flue temperature equals the desired temperature, the control system returns the burner to a low fire mode. Thus the temperature of the liquid in the shell is regulated. In an alternative embodiment, the size of the flame is infinitely variable through modulation.

It has been found that the heat exchanger 10 has an efficiency of about 86.5% fuel to water ratio when burning natural gas having a heat content of 420,000 BTU/1000 $ft^3$ ($3.7\times10^3$ gram-calories/liter). That is, at a high fire rate 89.6% of the heat energy in the gas is transferred to the water in the shell 12 and at a medium-fire rate, about 88.4% of the heat energy of the fuel is transferred to the water flowing through the shell 12. About 10% of total available energy in the fuel is lost through the exhaust flue 36, making the gas efficiency about 90%. Ambient temperature affects efficiency slightly, but humidity does not seem to make an appreciable difference, only about 1–2%.

In one application, the heat exchanger 10 is used to heat water that is continuously circulated through the cooling systems of diesel engines that are non running. The diesel engines are used to drive electric generators during peak demand periods and must be kept warm even when not running to prevent premature deterioration. Previously the utility had been using an electric water heater to keep the engine coolant warm. Capital costs for the electric water heater were about half of the capital costs for the heat exchanger 10, accounting for inflation. The recent cost of electricity to heat the water was about $104.67/day, while the cost of gas to operate the heat exchanger to produce the same amount of heated water is about $10.48/day, a savings of 89.98%.

It may sometimes be desirable to increase the heating capacity of the heat exchanger 10 without dramatically increasing the capacities of the heat generating elements, that is, the diameter of the tubes 15, the burner 16, induced draft blower 30 and the forced draft blower 100. In this case, two or more burners 16, tube bundles 14, and blowers 30, 100 may be arranged to heat liquid in a single shell 12.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

What is claimed is:

1. A boiler comprising a pressure vessel having a tube and shell heat exchanger comprising:

a. a tube bundle inside a shell, said tube bundle further comprising a single inlet end adjacent to an exterior surface of said shell and a single outlet end and said tube bundle further comprises a multi-pass tube bundle formed from a single tube;

b. a burner connected directly to said inlet end of said tube bundle, said burner adapted to project a flame directly into said inlet end of said tube bundle;

c. means for inducing a draft of ambient air through said tube bundle; and d. means for inducing a flow of liquid through said shell.

2. A tube and shell heat exchanger in accordance with claim 1 further comprising means for detecting the flow of liquid through said shell.

3. A tube and shell heat exchanger in accordance with claim 1 further comprising means for regulating the rate of flow of liquid through said shell.

4. A tube and shell heat exchanger in accordance with claim 3 wherein said regulating means further comprises at least one butterfly valve in a liquid flow tube outside of said shell.

5. A tube and shell heat exchanger in accordance with claim 1 where in said burner further comprises a gas burner.

6. A tube and shell heat exchanger in accordance with claim 1 further comprising means for forcing air into said inlet end of said tube bundle.

7. A tube and shell heat exchanger in accordance with claim 1 further comprising means for controlling the rate of air flow through said tube bundle.

8. A tube and shell heat exchanger in accordance with claim 7 wherein said air flow rate controlling means further comprises a butterfly valve in an exhaust tube of said tube bundle and means for automatically and electronically controlling how far opened or closed said butterfly valve is at any moment.

9. A tube and shell heat exchanger in accordance with claim 1 wherein said burner of said tube bundle and shell combination is adapted to project a flame in the direction of a burner outlet and further comprises means for automatically controlling the size of the flame in response to demands upon said tube and shell heat exchanger for heat.

10. A tube and shell heat exchanger in accordance with claim 1 wherein said tube bundle comprising means for admitting external ambient air and means for receiving a flame from a burner.

11. A tube and shell heat exchanger in accordance with claim 1 further comprising means for providing a layer ambient air adjacent to an interior side wall of said inlet end of said tube bundle thereby insulating said inlet end of said tube bundle from said flame.

12. A tube and shell heat exchanger in accordance with claim 1 further comprising means for regulating and controlling the temperature of the liquid in said shell.

13. A tube and shell heat exchanger in accordance with claim 12 wherein said liquid temperature regulating means further comprises means for regulating the flue temperature and for varying the size of the flame in response to changes in the flue temperature to maintain said liquid temperature.

14. A tube and shell heat exchanger in accordance with claim 1 further comprising means for infinitely varying the flame of said burner throughout a range from off to high flame condition through modulation.

15. A tube and shell heat exchanger in accordance with claim 1 further comprising a forced draft blower connected to the a rear portion of said burner whereby the recoverable heat produced by said burner is increased.

16. A tube and shell heat exchanger in accordance with claim 1 wherein said inlet tube of said tube bundle extends outwardly from said shell.

17. A tube and shell heat exchanger in accordance with claim 1 wherein said inlet end of said tube bundle and said outlet end of said tube bundle have the same diameter.

18. A boiler comprising a pressure vessel having a tube and shell heat exchanger comprising:

a. a tube bundle seated inside a shell, said tube bundle further comprising a multi-pass tube bundle formed from a single tube, said tube bundle having a single inlet end adjacent to an exterior surface of said shell and a single outlet end;

b. a variable flame burner operatively connected to an inlet end of said tube bundle;

c. an induced draft blower operatively connected to said outlet end of said tube bundle; and d. means for inducing a flow of liquid through said shell.

19. A boiler comprising a pressure vessel having a tube and shell heat exchanger in accordance with claim 17 further comprising automatically actuated electro-mechanical means for controlling the amount of heat produced by said burner, the temperature of the liquid inside said shell, and the temperature of the flue gases in said tube bundle of said heat exchanger.

* * * * *